US009475511B2

(12) United States Patent
Tippey et al.

(10) Patent No.: US 9,475,511 B2
(45) Date of Patent: Oct. 25, 2016

(54) PARALLEL TRACKS DESIGN DESCRIPTION

(71) Applicant: NEW YORK AIR BRAKE CORPORATION, Watertown, NY (US)

(72) Inventors: Jeffrey S. Tippey, Arlington, TX (US); Sean Adams, Elk Grove, CA (US); Sung-Ho Jee, Leeming (AU)

(73) Assignee: NEW YORK AIR BRAKE CORPORATION, Watertown, NY (US)

( * ) Notice: Subject to any disclaimer, the term of this patent is extended or adjusted under 35 U.S.C. 154(b) by 52 days.

(21) Appl. No.: 14/051,013

(22) Filed: Oct. 10, 2013

(65) Prior Publication Data

US 2015/0102176 A1 Apr. 16, 2015

(51) Int. Cl.

| | |
|---|---|
| ***B61L 3/00*** | (2006.01) |
| ***B61L 3/12*** | (2006.01) |
| ***B61L 15/00*** | (2006.01) |
| ***B61L 25/02*** | (2006.01) |

(52) U.S. Cl.

CPC ..... *B61L 3/006* (2013.01); *B61L 3/125* (2013.01); *B61L 15/009* (2013.01); *B61L 25/025* (2013.01); *B61L 2205/04* (2013.01)

(58) Field of Classification Search

CPC ..... B61L 3/00; B61L 3/002; B61L 3/004; B61L 15/00; B61L 15/0018; B61L 15/0027; B61L 15/0072; B61L 25/00; B61L 25/02; B61L 25/021; B61L 2205/02

USPC ..... 246/2 R, 2 E, 3, 4, 108, 122 R–124, 246/167 R, 176, 182 R; 701/19, 20

See application file for complete search history.

(56) References Cited

U.S. PATENT DOCUMENTS

| | | | | |
|---|---|---|---|---|
| 5,978,718 | A * | 11/1999 | Kull | 701/19 |
| 6,397,130 | B1 | 5/2002 | Carr et al. | |
| 7,317,987 | B2 * | 1/2008 | Nahla | 701/301 |
| 8,214,091 | B2 * | 7/2012 | Kernwein | B61L 25/025 246/122 R |
| 8,452,467 | B2 | 5/2013 | Kumar | |
| 2009/0105893 | A1 | 4/2009 | Kernwein | |
| 2009/0216395 | A1 | 8/2009 | Kernwein | |

OTHER PUBLICATIONS

International Search Report Form PCT/ISA/210, International Application No. PCT/US13/64329, pp. 1-3, Dated Mar. 7, 2014.

* cited by examiner

*Primary Examiner* — R. J. McCarry, Jr.

(74) *Attorney, Agent, or Firm* — Bond Schoeneck and King PLLC; David Nocilly

(57) ABSTRACT

Disclosed embodiments provide a system and methodologies that enable or improve a train operator's ability to detect when his train will or has switched tracks or routes automatically in response to the train switching tracks or route without input from the train operator. Disclosed embodiments enable automatic determination of a route that the train is currently on and the route the train is supposed to switch to and the ability to predict track/route switches before they occur. Thus, the disclosed embodiments are configured to more effectively provide proper driving instructions through the track/route change, instead of merely reacting to the track/route change.

18 Claims, 9 Drawing Sheets

PARALLEL TRACKS DESIGN DESCRIPTION

FIELD

Disclosed embodiments provide a method for improving the ability to enhance safety by providing information associated with trains' track/route switching by using wayside signaling.

BACKGROUND

Various conventional train protection systems have been developed around the globe with the goal to provide railway technical installations to ensure safe operation in the event of human failure.

Positive Train Control (PTC) refers to conventionally known technology that is designed to prevent train-to-train collisions, overspeed derailments, casualties or injuries to roadway workers operating within their limits of authority as a result of unauthorized incursion by a train as well as prevent train movements through a switch left in the wrong position. Although PTC systems vary widely in complexity and sophistication based on the level of automation and functionality they implement, the system architecture utilized and the degree of train control they are capable of assuming, PTC systems are consistent in that they are processor-based signal and train control systems (see Title 49 Code of Federal Regulations (CFR) Part 236, Subpart H) that utilize both computers and radio data links to accomplish PTC functions, e.g., monitoring and controlling train movements to provide increased safety.

More specifically, PTC requires that a train receives information about its location and where it is allowed to safely travel, i.e., "movement authorities." Equipment on board the train enforces these movement authorities thereby preventing unsafe movement. PTC systems often use Global Positioning System (GPS) navigation to track train movements or utilize other mechanism to calculate their track location. Thus, PTC is meant to provide train separation or collision avoidance, line speed enforcement, temporary speed restrictions and ensure rail worker wayside safety.

However, various other benefits may be achieved by use of PTC; for example, the information obtained and analyzed by PTC systems can enable on-board and off-board systems to control the train and constituent locomotives to increase fuel efficiency and to perform locomotive diagnostics for improved maintenance. Because the data utilized by the PTC system is transmitted wirelessly, other applications can use the data as well.

Early train protection systems were termed "train stops," which are still used by various metropolitan subway systems. In such implementations, beside every signal is a moveable clamp, which touches a valve on a passing train if the signal is red and opens the brake line, thereby applying the train's emergency brake; if the signal shows green, the clamp is turned away and does not impede operation of the train.

Other systems include the Integra-Signum system, wherein trains are influenced only at given locations, for instance whenever a train ignores a red signal, the emergency brakes are applied and the locomotive's motors are shut down. Additionally, such systems often require the operator to confirm distant signals (e.g., Continuous Automatic Warning System-CAWS) that show stop or caution; failure of a train operator to respond to the signal results in the train stopping. Such an implementation provides sufficient braking distance for trains following each other; however, such confirmation based systems do not always prevent accidents in stations where trains cross paths, because the distance from the red signal to the next obstacle may be too short for the train to brake to a stop.

More advanced systems, e.g. PZB or Indusi provide intermittent cab signaling and a train protection system that calculate a braking curve that determines if the train can stop before the next red signal, and brakes the train if the train cannot do so. One disadvantage to this approach is that acceleration of the train is prevented before the signal if the signal has switched to green. To overcome that problem, some systems, such as the Linienzugbeeinflussung, allow additional magnets to be placed between distant and home signals, or data transfer from the signaling system to the onboard computer is continuous.

Newer conventional PTC train protection systems use cab signaling, wherein the trains constantly receive information regarding their relative positions to other trains. In such systems, on-train computer processors run software that shows the train operator how fast he may drive, instead of him relying on exterior signals. Systems of this kind are in common use for high speed trains, where the speed of the trains makes it difficult if not impossible for the train operator to read exterior signals, and lengths of trains or distances between distant and home signals are too short for the train to brake.

SUMMARY

In accordance with disclosed embodiments, a system and methodologies are provided that enable or improve a train operator's ability to detect when his train will or has switched tracks or routes. In accordance with disclosed embodiments, the system and methodologies can do so automatically in response to the train switching tracks or route without input from the train operator.

Disclosed embodiments enable automatic determination of a route that the train is currently on and the route the train is supposed to switch to.

In addition, disclosed embodiments enable the ability to predict track/route switches before they occur. Thus, the disclosed embodiments are configured to more effectively provide proper driving instructions through the track/route change, instead of merely reacting to the track/route change.

DETAILED DESCRIPTION

Disclosed embodiments improve a train operator's ability to detect when his train will or has switched tracks or routes. In accordance with disclosed embodiments, the system and methodologies can do so automatically in response to the train switching tracks or route without input from the train operator.

Throughout the present disclosure, descriptions refer to Automated Train Protection (ATP) signals and features. It should be understood that the presently disclosed embodiments may be used in conjunction with ATP systems and/or other PTC systems in use throughout the world. Therefore, any reference to either ATP or PTC system features is merely illustrative and not limiting to the utility of the presently disclosed embodiments.

Conventional use of Global Positioning System (GPS) location technology to determine a track/route switch is not practical for a number of reasons. First, in implementation, GPS technology does not reliably discriminate between parallel tracks that are within the vicinity of each other. Additionally, GPS cannot predict a route switch; thus, use of GPS technology fails to provide reliable driving advice to the train operator.

To address these issues, disclosed embodiments may be implemented to capture wayside signals and select an appropriate route from this data. As such, disclosed embodiments are able to automatically determine a route that the train is currently on and the route the train is supposed to switch to.

Thus, disclosed embodiments capture wayside signaled information and select an appropriate route from this data to automatically determine a route that the train is currently on and the route the train is supposed to switch to when approaching one or more turnouts (i.e., location of an opportunity to switch to a different track or route). Thus, disclosed embodiments enable the ability to predict track/route switches before they occur and provide proper driving instructions to the train operator throughout a track/route change, instead of merely reacting to the track/route change.

Figure 1:
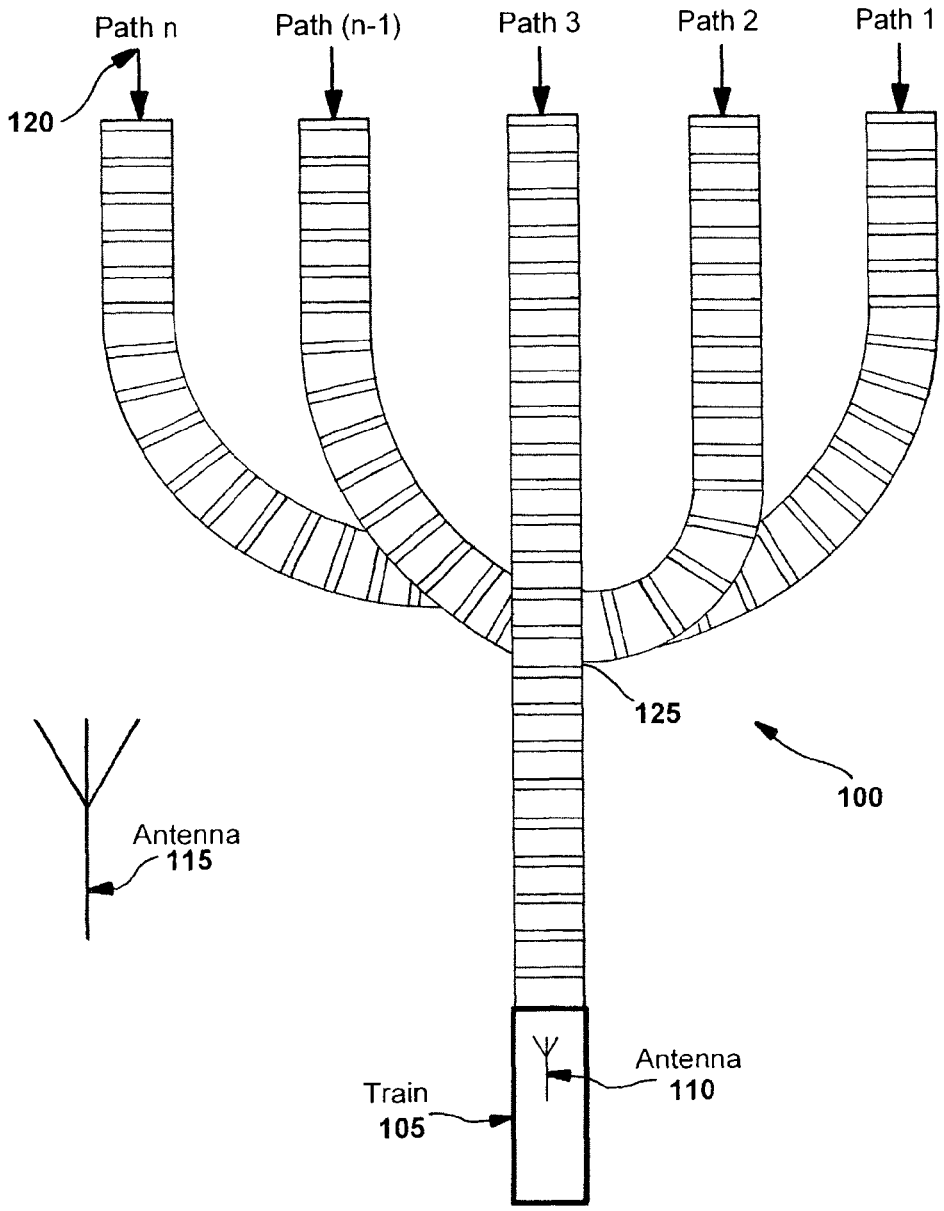
FIG. 1 illustrates a rail system in which disclosed embodiments may be implemented to facilitate improved train and turnout navigation.

For example, as shown in FIG. 1, within a rail system 100, a train 105 may travel upon a track comprised of various alternative paths 120 (paths 1-n). Disclosed embodiments, utilize communication of signals between the antenna 110 located on the train and one or more wayside antennas 115 to determine the location of the train in relationship to an upcoming turnout location 125, wherein the train could switch to a different path 120.

Generally speaking, PTC systems such as Automated Train Protection (ATP) provide three types of turnout indications: MainLine (meaning that the train is signaled to stay on the Main Line (ML)), Left Turnout (meaning that the train is signaled to take the LeftTurnout (LT) it is approaching, and Right Turnout (meaning that the train is signaled to take the RightTurnout (RT) it is approaching).

Using various conventional ATP (or PTC) systems, the turnout indication may be acquired from the cab codes, which may be controlled by interlocking. For example, they may be sent as a 40 Hz current along the rails and received by coils in front of the leading wheels. In such a situation, there may be 4 different cab codes: 50-code (Turn-out route next, 60 km/h at the end of the current block, i.e. LoA=end of next block); 75-code (Next "signal" at "stop", i.e., LoA=end of current block); 120-code (Next "signal" at "caution", i.e., LoA=end of next block); 180-code (Next "signal" at "clear", i.e., LoA=not defined beyond end of next block). Thus, in such an implementation, when the cab code is the 50-code, the ATP system may indicate the turnout information as either "LT" or "RT", for being Left Turnout or Right Turnout, respectively. For other codes, the turnout information may be "ML" for MainLine.

Turnout information applies to the next route after the next signal in the direction of travel. Therefore, the ATP turnout indication may conceptually be considered to be an advance turnout indication or instruction.

In accordance with at least one of the disclosed embodiments, turnout indications are transmitted to the train control software via the communication signals transmitted from each wayside signal antenna 115 to the on-train antenna 110. Thus, the turnout indications are made available for reading along the length of the route and may change after passing each signal is received from each of a plurality of antennas (e.g., antenna 115) provided along the wayside of the track.

By using the wayside antenna signal information, software running on the train is better able to determine the present location of the train objectively and in relationship to the various routes/tracks 120 as well as receive advance turnout indications for turnouts that it is approaching on the track 120 along the train's current profile, where the current profile is defined as the current specified route through the track network that the train is intending to take. However, the current profile can change at any turnout or intersection in the track network.

Moreover, by using the wayside signal information, the train software implemented control systems are able to receive, process and respond to changes in turnout indication as the train approaches a turnout. This may be, for example, because a route may actually change as the train travels along the route, when there is a change to the status of the next route, e.g., by the ATP based on various field conditions such as a track fault or updated track condition. As a result, the ATP turnout indication can change as a train approaches the next route.

Figure 2:
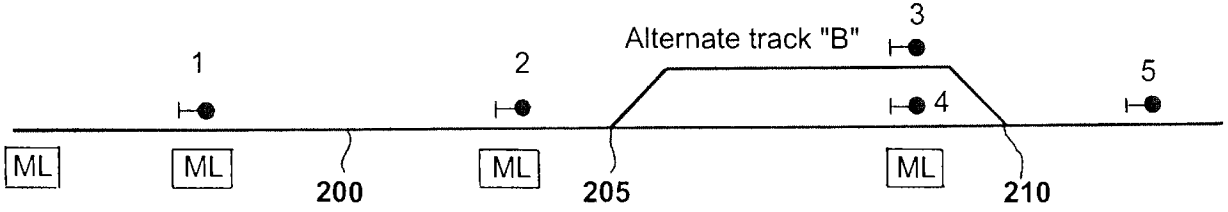
FIG. 2 illustrates an example of a turnout that may be navigated in accordance with disclosed embodiments.

FIG. 2 shows the ATP turnout indication displayed as a train moves on the MainLine (ML). The box with "ML", "RT" or "LT" located under the track 200 represents the turnout indication displayed to the operator from an antenna (e.g., antenna 115 illustrated in FIG. 1) at that track location. Note, the train does not switch onto the Alternative track "B" at the turnout 205 because the train has been signaled to stay on the MainLine (ML) throughout Signals (e.g., from corresponding wayside antennas) 1, 2 and 4.

Figure 3:
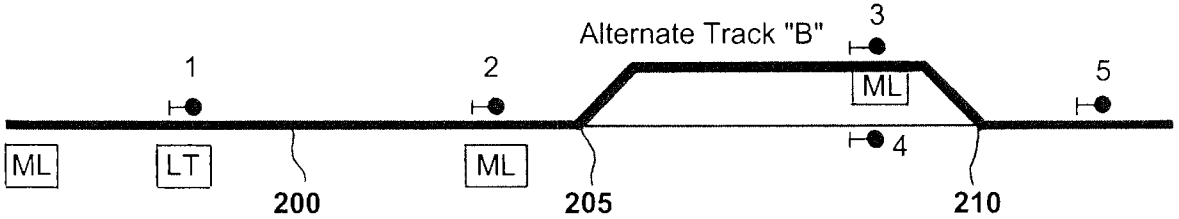
FIG. 3 illustrates a second example of turnout configuration that may be navigated in accordance with disclosed embodiments.

FIG. 3 illustrates how the ATP turnout indication displayed as a train takes a LeftTurnout onto passing tracks and continues on. Note the train signaled at Signal 1 to take a LeftTurnout. However, the turnout indication changes back to "ML" after passing Signal 2 as the operator has already been informed of the turnout LT between Signal 1 and Signal 2. Furthermore, that MainLine ML signal is maintained at Signal 3 and the train returns to the MainLine ML off of Alternate Track "B" at the junction 210.

It should be understood that one may expect the signals to continue to be LT until after the head of the train has passed the start of Alternative track B. Alternatively, the train may be given a ML signal before the train enters the LT; thus, one may, alternatively, expect that the train would no longer turnout at the intersection and would stay on the ML. Either implementation is possible and the point at which the signal is changed may be customizable to safety requirements preferred or set by a system.

In accordance with disclosed embodiments train control software should maintain the Current Track as "Alternative Track "B" until the end of the train has cleared the exit of the loop (i.e., the Alternate Track B together with that portion "A" of the MainLine ML that is parallel to the Alternative Track "B") so that the train consist is rendered on the loop properly and the correct speed restrictions from the ATP are applied.

However, at the same time, a legitimate change of the turnout indication in the track section between Signal 1 and Signal 2 would need to lead to the Current Track being set accordingly. Thus, disclosed embodiments utilize a set of ATP transponders that are associated with a Signal; in accordance with disclosed embodiments, the on-train, train control and operator assistance system (for example, commercially available systems marketed by New York Air Brake under the "LEADER" trademark) on a train passing these transponders receives communication from the transponders via an ATP Transponder message. Thus, the on-train, train control and operator assistance system can be used to detect the type of the turnout indication change. For example, if the turnout indication changes before Signal 2 illustrated in FIG. 3, the Current Track value may be changed immediately. Thereafter, if the turnout indication changes after Signal 2 (which will always be back to "ML"), the Current Track value can be ignored and the Current Track value may be set back to 'A' once the end of the train clears the exit point of the loop.

In accordance with disclosed embodiments, an on-train, train control and operator assistance system utilizing the disclosed embodiments may use ATP maximum section speed and ATP maximum train speed to guide operator assist prompting.

One limitation of the conventional use of ATP turnout information is that on-train, train control and operator assistance systems cannot differentiate between multiple "RT" routes or multiple "LT" routes where more than two routes may exist at a single signal.

Figure 4:
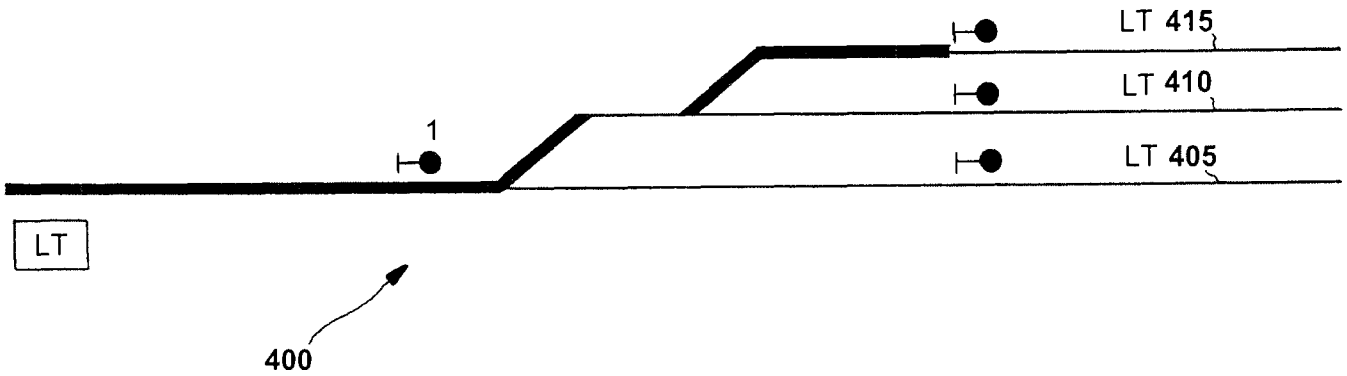
FIG. 4 illustrates a third example of a turnout configuration that may be navigated in accordance with disclosed embodiments.

More specifically, consider the example layout illustrated in FIG. 4. As shown in that figure, if the two "LT" routes 410, 415 were to lead to two different destinations, e.g., mines, then each option would have a different profile in the on-train, train control and operator assistance system. Accordingly, subsequent routes in the different profiles would likely have different speed restrictions in effect; however, the on-train, train control and operator assistance system would have no way of determining that in advance based on only the ATP turnout indication of "LT" before Signal 1 shown in FIG. 1.

As a result, conventional on-train, train control and operator assistance systems would not be able to recommend accurate throttle/brake settings leading up to Signal 1 until a profile switch is confirmed after encountering some transponders known to be on another profile. This is because any "Look Ahead" functionality, which encompasses future predictions of the trains dynamics such as: speed, acceleration, braking forces, and in-train forces given the current train control setting (i.e. throttle, dynamic brake, and airbrake settings) and their subsequent comparisons to the track thresholds (i.e. speed restriction limits and driving thresholds) of the on-train, train control and operator assistance system cannot include the correct speed restrictions in effect.

Figure 5:
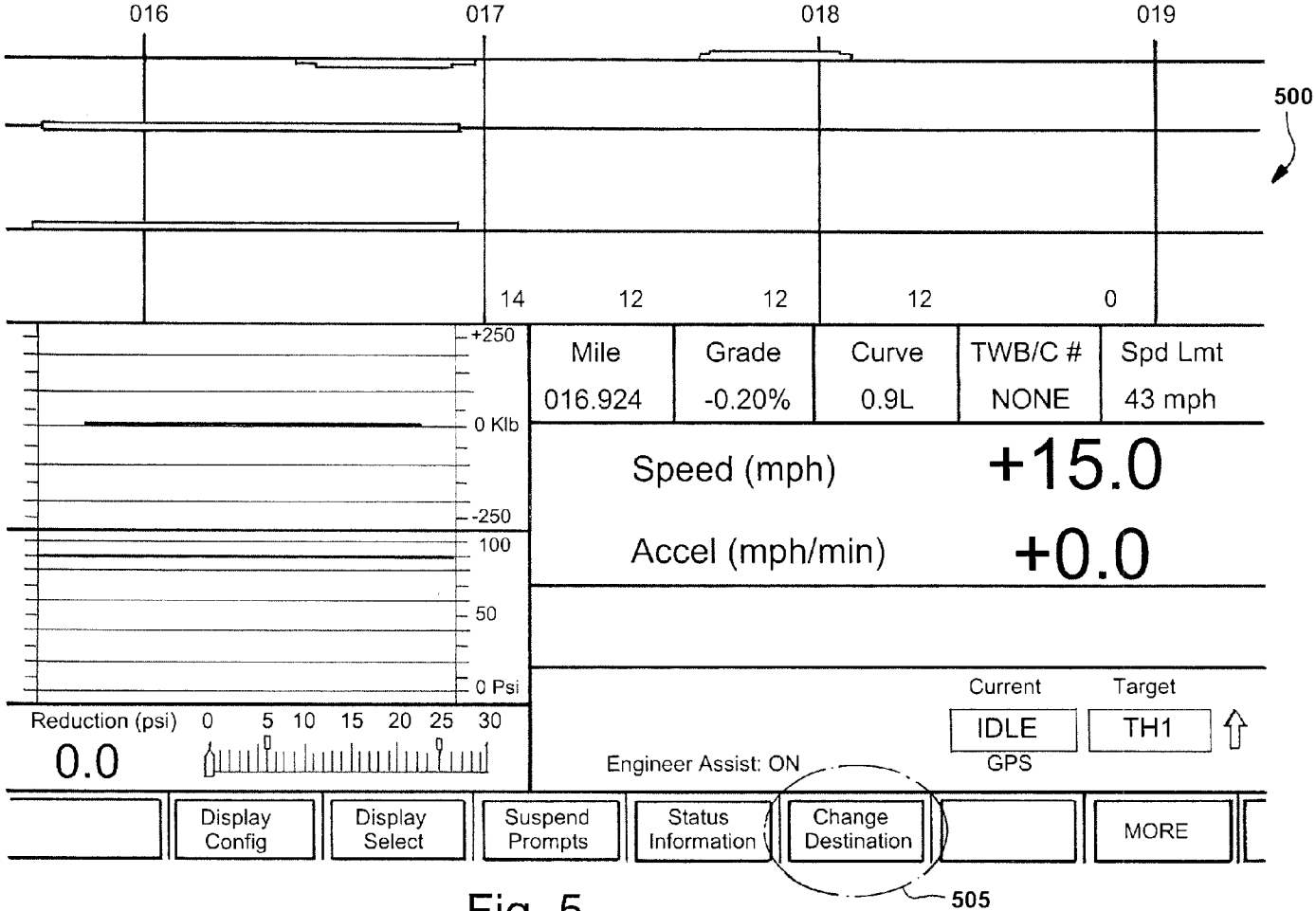
FIG. 5 illustrates an example of a user interface provided for the on-train, train control and operator assistance system.

One way of addressing this issue is to require the train operator to specify any destination change using a user interface of the on-train, train control and operator assistance system. As shown in FIG. 5, such a mechanism for an on-train, train control and operator assistance system may be provided to require a train operator to select two icons to select an alternative destination.

Thus, as shown in FIG. 5, the user interface 500 may include a 'Change Destination' icon 505 in the basic row of soft function keys provided in an on-screen user interface. Thus, upon receiving a selection of the "Change Destination" icon from a train operator, the on-train, train control and operator assistance system could be configured to determine the direction of travel (e.g., based on increasing chainage or decreasing chainage) for the train and, depending on that direction of travel, display a list of potential destinations associated with that direction of travel based on train system data available to the on-train, train control and operator assistance system (e.g., in stored memory on board and accessible by one or more computer processors running software to implement the on-train, train control and operator assistance system or accessible via accessing off-train data via a communication interface implemented in the on-train, train control and operator assistance system).

After receiving selection of the new destination associated with one of the displayed potential destinations, the system could then update the current profile and switch to it to provide train operator assistance based on the profile.

Figure 6:
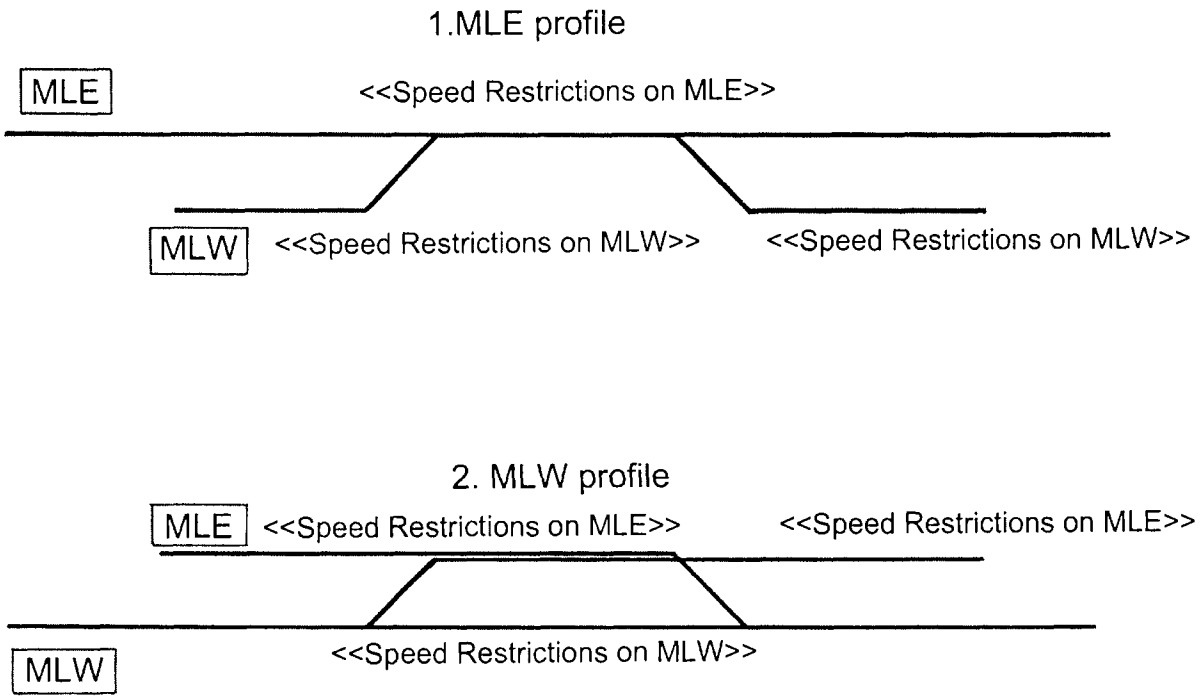
FIG. 6 illustrates a fourth example of turnout configurations that may be navigated in accordance with disclosed embodiments.

Accordingly, disclosed embodiments enable the ability to increase the extent of overlap of alternate routes so that "Look Ahead" functionality of on-train, train control and operator assistance system can access the speed restrictions issued by an ATP system for another mainline as a crossover is approached. This is possible as a result of track profile design and back office support (e.g., information and infrastructure managed and utilized by the users of a track system running trains utilizing the disclosed embodiments). For example, each alternate route representing a crossing may have its leg extended out to, e.g., 3 miles to account for the "Look Ahead" distance. Thus, when back office software receives speed restriction data, then on-train, train control and operator assistance system software can create speed restrictions for the alternate leg. This allows the on-train, train control and operator assistance system Look Ahead software to use the speed restrictions in the target profile when the ATP turnout indication notifies the on-train, train control and operator assistance system of the impending crossover, as illustrated in FIG. 6.

Disclosed embodiments may use ATP target speed and a distance to target value to guide Operator Assist prompting. More specifically, once a target location is defined, the ATP may counts down the distance to target as communicated in an ATP Screen Refresh message. Thus, an on-train, train control and operator assistance system may compute the initial target location to be, for example, 5% closer. Therefore, as the ATP counts down the distance to the target location, the on-train, train control and operator assistance system may update the target location if the newly computed target location is closer, which accounts for the 5% of the distance to target getting smaller as the train approaches the target, hence the possibility of the computed target location getting further away. However, if the computed target location is further away from the current target location by 1 km, then it may be assumed that this is a genuine extension of a Limit of Authority (which may provide the specific location on the current track profile/route that the train is authorized to go up to but not pass beyond) and the target location may be updated.

In accordance with the disclosed embodiments, the crossovers between a Main Line in the East direction (MLE) and a Main Line in the West direction (MLW) may also be navigated more effectively. In addition, a separate configuration (similar to decision points or the switch table utilized in an on-train, train control and operator assistance system)

may specify the target profile at the end of the crossover. Furthermore, speed restrictions in the target profile may be used by the on-train, train control and operator assistance system's Look Ahead functionality software as the train approaches the crossover.

However, proper navigation by the on-train, train control and operator assistance system also requires that a legitimate change of turnout indication at a location approaching a turnout (e.g., in the section between Signals 1 and 2 in FIGS. 2-3) should lead to the Current Track being set accordingly by the on-train, train control and operator assistance system.

Accordingly, if the turnout indication changes before Signal 2, the Current Track is changed immediately. However, if the turnout indication changes after Signal 2 (which will always be back to "ML") then the indication change will be ignored (thus, as in FIGS. 2-3, the current Track is set back to 'A' once the end of the train clears the exit point of the loop.

In accordance with disclosed embodiments, the location of Signal 2 may be derived from a fractional MP or milepost, where the milepost is a specific location on the current track profile/route value associated with the signal element in the stored data for the track network that contains speed restrictions for the current profile and locations of important items for the track network such as turnout locations, transponders, hot boxes, etc. Alternatively, the location may be derived from the fractional MP value associated with the signal in a configuration file used by the on-train, train control and operator assistance system.

In order to account for errors in the on-train, train control and operator assistance system internal chainage, the effective location of the signal may be brought forward (for example, closer to an approaching train) by, e.g., 500 meters (this value may be configurable within the on-train, train control and operator assistance system).

In accordance with disclosed embodiments, an on-train, train control and operator assistance system may be configured to use ATP transponder messages to switch train profiles. It should be understood that a transponder in a rail system may belong to 0 or more on-train, train control and operator assistance system track profiles. By associating a transponder with a list of on-train, train control and operator assistance system track profiles, the transponder can be identified in a configuration file, and the on-train, train control and operator assistance system is able to automatically switch the track profile when it receives a transponder event from the ATP system.

Such an on-train, train control and operator assistance system configuration file can remove certain redundant entries taking advantage of the fact that a number of transponders can belong to the same group. Accordingly, a transponder group can be identified by an ATP track line number, an Alternate Transponder Group Number and a range of ATP Track Positions in the group. Thus, a transponder group can be associated with the set of profiles it belongs to.

Furthermore, a default track profile can be selected for each transponder group. For example, a transponder group on Main Line West may have its default profile set as *MLW. This wildcard notation (*) may be used to select the most appropriate profile when switching from MLE by retaining the same start and destination. For example, when switching from 7M-BF via MLE after encountering a transponder whose default profile is *MLW, a new profile may be selected as 7M-BFviaMLW.

The concept of a default track profile may also be useful when diverging from a junction station where there are more junction stations down the track, for example, when a final destination for the train is not yet known. A signal may be assumed to be associated with all parallel routes at that chainage.

Disclosed embodiments may be implemented, at least in part, by managing state transitions for data variables. Management of next state transitions may be the responsibility of a current state. Thus, setting or clearing of any state variable may also be the responsibility of the current state before transitioning states.

Figure 7A:
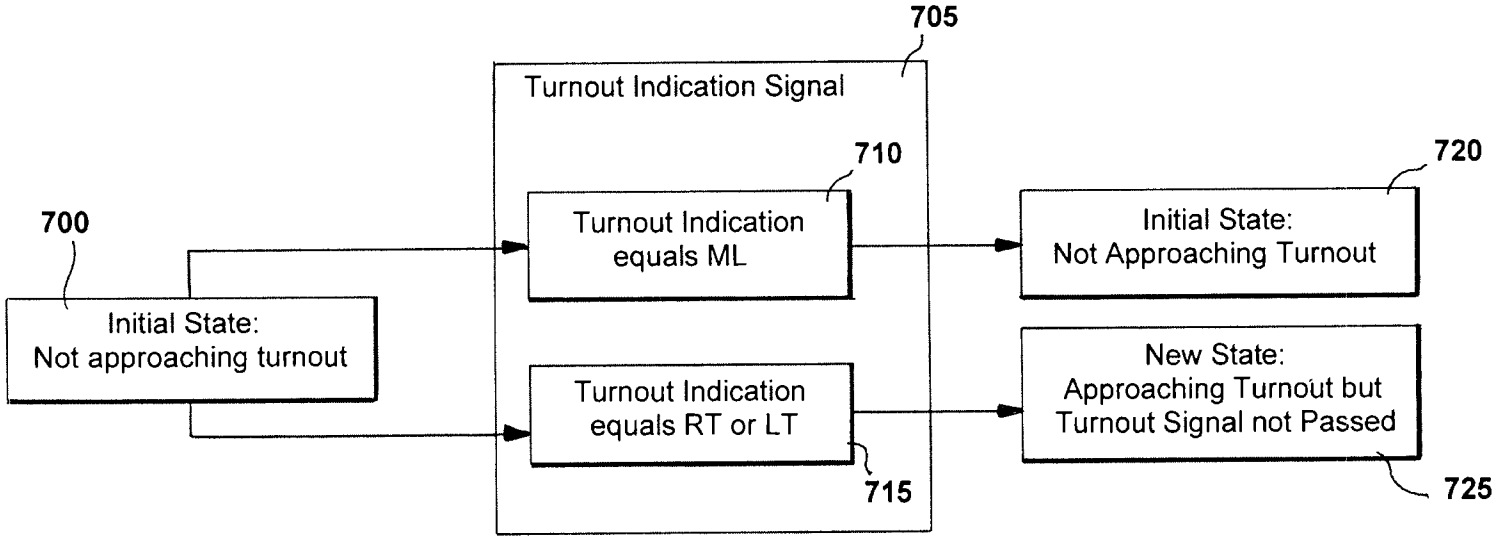
FIGS. 7A-C illustrate a methodology performed in accordance with disclosed embodiments for facilitating turnout navigation.
Figure 7B:
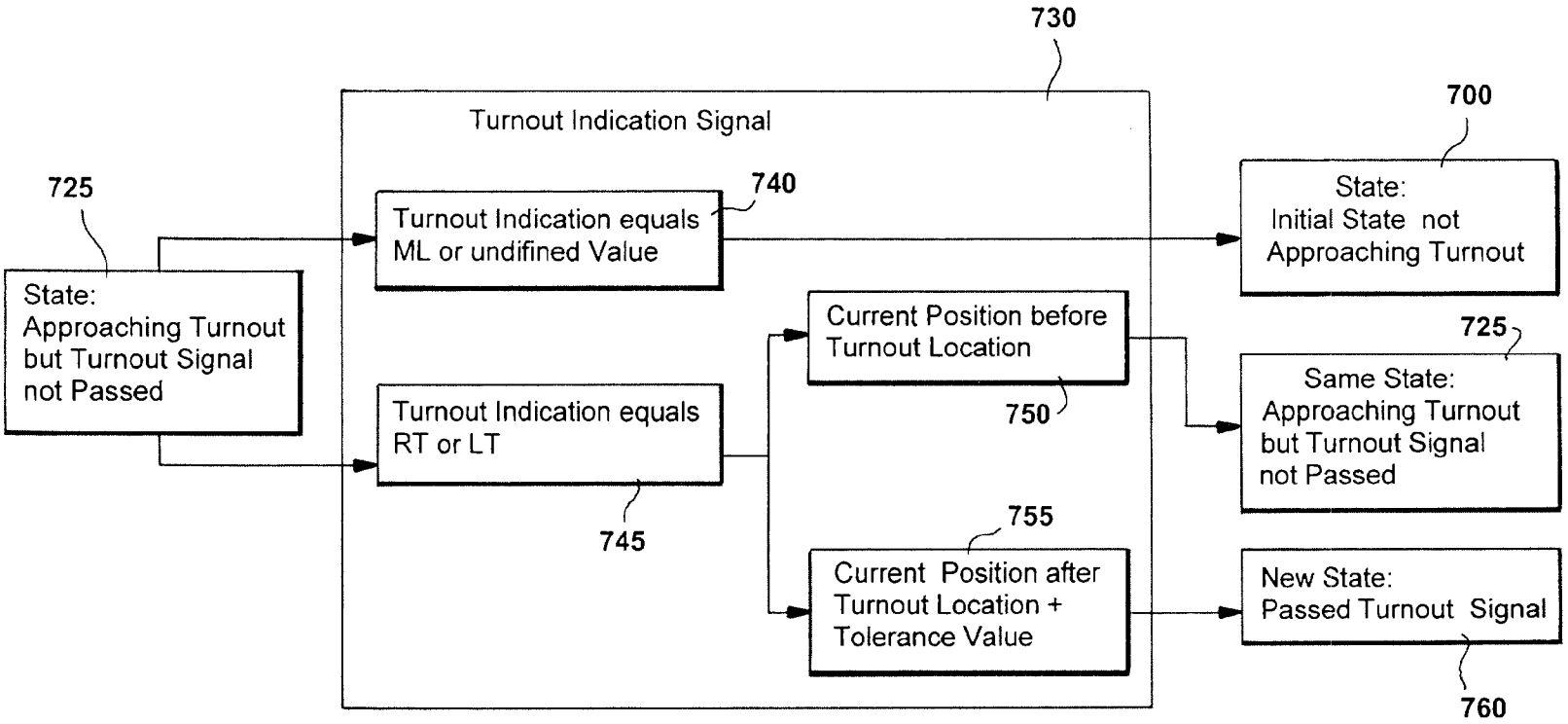
Figure 7C:
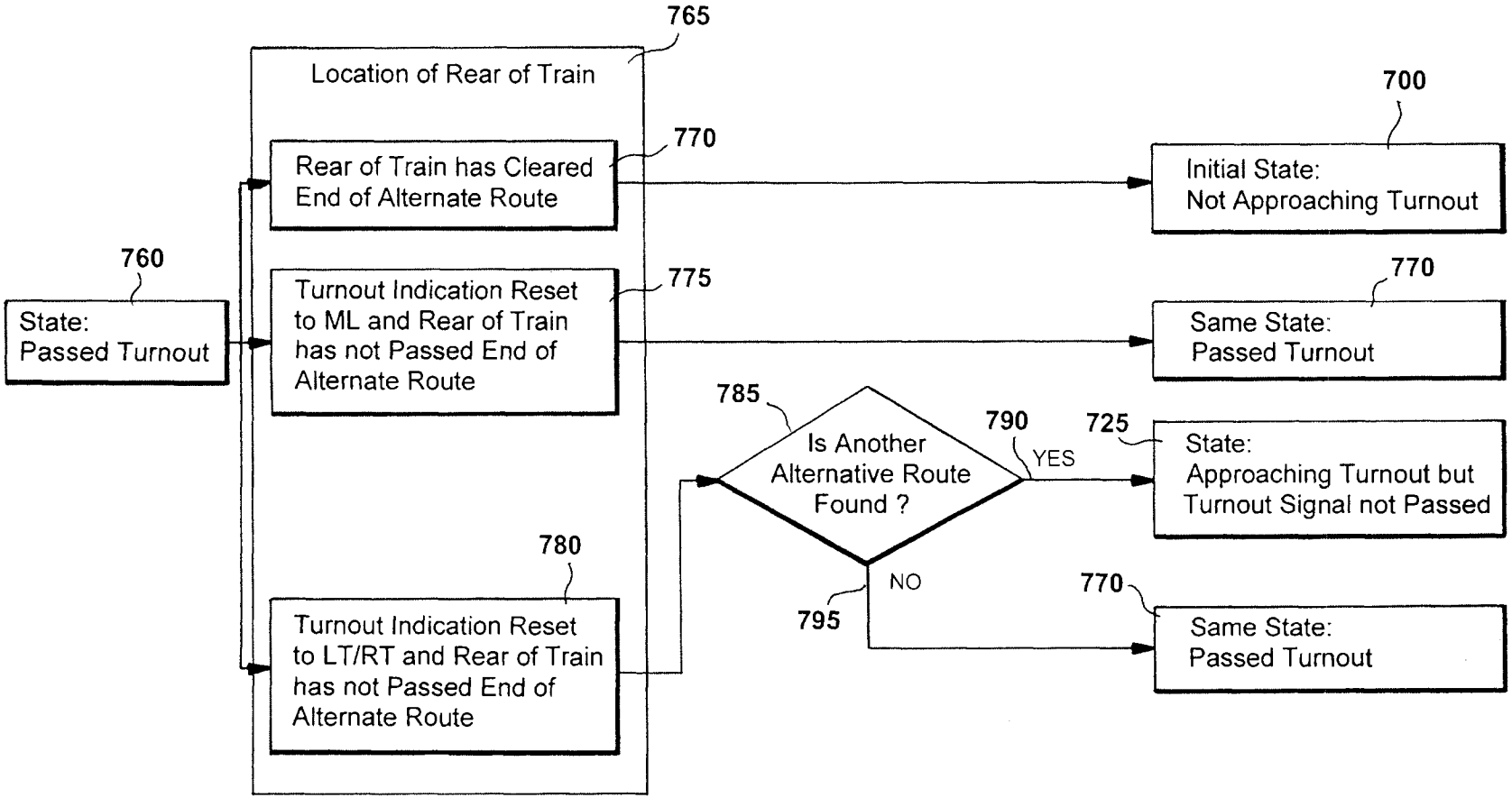

FIGS. 7A-C illustrate a methodology performed in accordance with disclosed embodiments for facilitating turnout navigation utilizing such state transitions. As shown in FIG. 7A, an initial state 700 may be that the train is not approaching a turnout. Once the on-train, train control and operator assistance system receives a turnout indication signal 705 from a wayside transponder, it must be determined whether the turnout indication equals ML (Main Line) 710 or RT (Right Turnout)/LT (Left Turnout) 715. If the indication signal equals ML, then the initial state remains as "not approaching turnout" at 720. However, if the turnout indication equals RT/LT, then the state transitions to "approaching turnout but turnout signal not passed" 725.

From this state 725, also shown in FIG. 7B, receipt of another turnout indication signal 730 may indicates one of two notifications: the turnout indication equals ML or an undefined value 740 or the turnout indication equals RT/LT 745. If the turnout indication equals ML or an undefined value, it may be that the approaching turnout indication was in error, thus the state transitions back to the "initial state: not approaching turnout" 700.

Alternatively, if the turnout indication equals RT/LR at 745, then it is determined whether the current position of the train is before the turnout location 750 or after the turnout location (plus a tolerance value of, for example, 1 km to ensure accurate state transitions). If the train's current location is before the turnout location, the state is maintained as "approaching turnout but turnout signal not passed" 725; however, if the current train location is after the turnout plus the tolerance value, the state transitions to a new state of "passed turnout signal" 760.

In this state 760, also shown in FIG. 7C, a determination is made as to the location of the rear of the train 765 based on received wayside transponder signaling. This determination has three options: rear of train has cleared the end of the alternate route (e.g., Alternate Route B shown in FIGS. 2-3) 770, the rear of the train has not passed the end of the alternate route and the turnout indication is reset to Main Line (ML) 775 and the rear of the train has not passed the end of the alternate route but the turnout indication is reset to LT/RT 780. If the rear of the train has cleared the end of the alternate route at 770, the state transitions back to the initial state "not approaching turnout" 700. If the rear of the train has not passed the end of the alternate route and the turnout indication signals a reset to ML, then the state remains as "passed turnout" 770.

The determination at 780 tests for the potential for the presence of multiple turnouts, and, as a result, presence of multiple alternative routes. More specifically, file data stored on the train or accessible by the train may be used by the software implementing the on-train, train control and operator assistance system to locate items of interest in a track network; such areas of interest may be designated in stored data associated with various track profiles. Generally, identifiers at these locations indicate the possibility of multiple routes and enable the system to take this into account when a train is in such areas. Thus, at 780, it is determined whether another alternative route is found 790 or not 795. If another alternate route is found at 790, the state is transitioned back to "approaching turnout but turnout signal not passed" 725 shown in FIGS. 7A-B. If no alternate route is found, the state remains "passed turnout" 770 until signaling from another wayside transponder is received. Such wayside transponders (corresponding to antenna 115 illustrated in FIG. 1) are often provided every 10-15 km apart along the train track.

Disclosed embodiments may be implemented in conjunction with various on-train, train control and operator assistance systems and components thereof. Thus, it should be understood that disclosed embodiments may be incorporated in or be coupled to on-train, train control and operator assistance system components including, for example, a PTC system module that may include hardware, software, firmware or some combination thereof that provide a speed display, a speed control unit on at least one locomotive of the train, a component that dynamically informs the speed control unit of changing track or signal conditions, an on board navigation system and track profile database utilized to enforce fixed speed limits along a train route, a bi-directional data communication link configured to inform signaling equipment of the train's presence so as to communicate with centralized PTC systems that are configured to directly issue movement authorities to trains.

Figure 8:
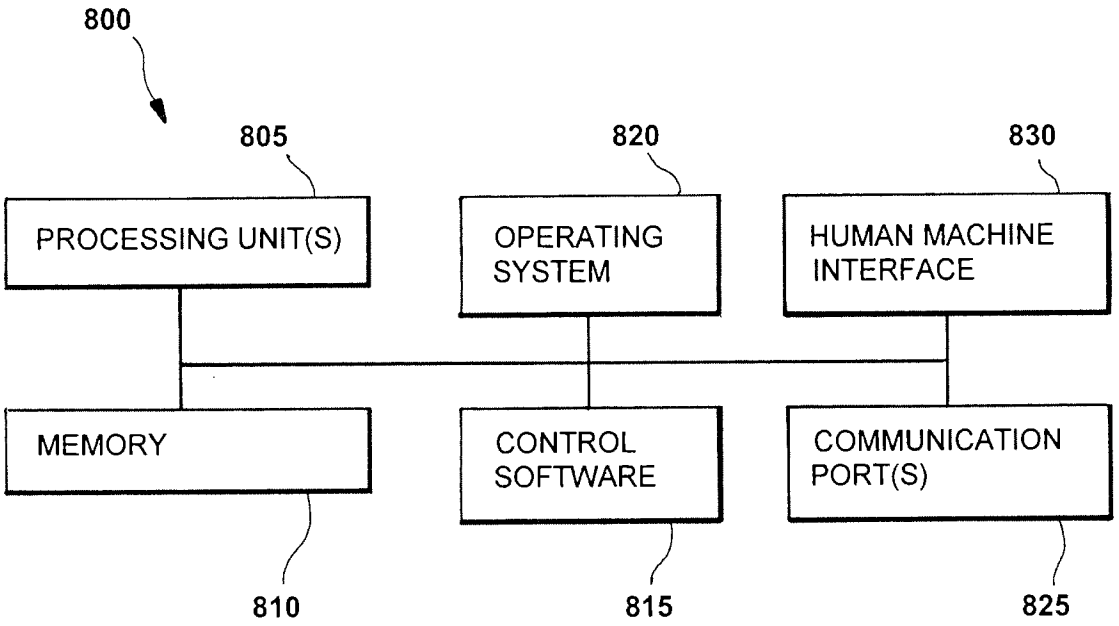
FIG. 8 illustrates an example of equipment that may be used to provide the disclosed embodiments.

Thus, the above-identified functionality may be implemented in various combinations of the above-identified hardware, software and firmware. Accordingly, to perform these types of operations, the train intelligence provided to perform these operations may include (but is not limited to) the equipment illustrated in FIG. 8. As shown in that figure, the train intelligence 800 may be included on the train 105 (shown in FIG. 1). Regardless of the implementation, the train intelligence 800 may include one or more computer processing units 805 that may be coupled to memory 810 (implemented as one or more conventionally known and commercially available programmable and/or read only or reprogrammable memory devices). The memory 810 may serve to store computer instructions associated with or implementing both control software 815 and optionally an operating system or environment 820 for performing operations included in one or more computer applications, software code packages and/or various called or included subroutines. These instructions may be used to perform the instructions included in the methodologies and determinations described above.

Moreover, the train intelligence may also include one or more communication ports 825 that enable both receipt and transmission of messaging and signaling (such as the signaling received from the wayside transponders), data and control instructions in accordance with the disclosed embodiments. Furthermore, the train intelligence 800 may include a human machine interface 830 that may include, for example, a display that enables an operator to receive and review data utilized or produced by the train intelligence 800, provide instruction or input direction to the control software 815, access data included in the memory 810, etc. As a result, the human machine interface 830 may also include other conventionally known features including a keyboard, a mouse, a touch pad, various buttons and switches, etc.

The invention claimed is:

1. A train navigation system, comprising:

a train control system for positioning onboard a train, wherein the train control system includes a processor, a database associated with the processor that includes a track profile having predetermined parameters on how the train should be operated along a particular route, and an antenna for receiving a turnout indication signal from a wayside transponder; and wherein the processor is programmed to determine the location of the train from the turnout indication signal, to assess whether a change in the operation of the train is required as a result of a change in the particular route that is indicated by the turnout indication signal, and to use the wayside transponder signal to discriminate between parallel train tracks that are within the vicinity of each other.

2. The train navigation system of claim 1, wherein the processor is also programmed to determine the location of the train using Global Positions System data.

3. The train navigation system of claim 1, further comprising a user interface coupled to the processor, wherein the processor is programmed to provide driving advice to a train operator of the train via the user interface based on the determined location of the train and the track profile.

4. The train navigation system of claim 3, wherein the processor is programmed to output train operator advice via the user interface if a change in the operation of the train is required.

5. The train navigation system of claim 3, wherein the track profile includes speed restrictions along the particular route.

6. The train navigation system of claim 5, wherein the processor is programmed to output driving advice that takes into consideration the speed restrictions along the particular route.

7. The train navigation system of claim 3, wherein the driving advise comprises a new route the train is supposed to switch to based on the wayside transponder signal and how the driver should operate the train on the new route.

8. A train navigation system, comprising:

a train control system for positioning onboard a train, wherein the train control system includes a processor, a database associated with the processor that includes a track profile having predetermined parameters on how the train should be operated along a particular route, and an antenna for receiving a turnout indication signal from a wayside transponder;

a user interface coupled to the processor, wherein the processor is programmed to provide driving advice to a train operator of the train via the user interface based on the determined location of the train and the track profile; and wherein the processor is programmed to determine the location of the train from the turnout indication signal, to assess whether a change in the operation of the train is required as a result of a change in the particular route that is indicated by the turnout indication signal, and to predict changes in the particular route based on the received wayside transponder signal.

9. A train navigation system, comprising:

a train control system for positioning onboard a train, wherein the train control system includes a processor, a database associated with the processor that includes a track profile having predetermined parameters on how the train should be operated along a particular route, and an antenna for receiving a turnout indication signal from a wayside transponder; and wherein the processor is programmed to determine the location of the train from the turnout indication signal, to assess whether a change in the operation of the train is required as a result of a change in the particular route that is indicated by the turnout indication signal, and to select an appropriate route for the train based at least in part on the wayside transponder signal.

10. A method of providing advice to a train operator for train navigation, the method comprising:

providing a train control system for positioning onboard a train, wherein the train control system includes a processor, a database associated with the processor that includes a track profile having predetermined parameters on how the train should be operated along a particular route, and an antenna for receiving a turnout indication signal from a wayside transponder, wherein the processor is programmed to determine the location of the train from the turnout indication signal, to assess whether a change in the operation of the train is required as a result of a change in the particular route that will occur from an upcoming turnout indicated by the turnout indication signal, and to use the wayside transponder signal to discriminate between parallel train tracks that are within the vicinity of each other;

receiving a turnout indication signal from a wayside transponder;

determining a location of the train in relationship to at least one track turnout based on the turnout indication signal;

identifying whether a change in the particular route of the train is required based on the turnout indication signal; and determining whether a change in the operation of the train is required as a result of the turnout indication signal.

11. The method of claim 10, wherein the processor is also programmed to determine the location of the train using Global Positions System.

12. The method of claim 10, wherein the train control system further comprises a user interface coupled to the processor, wherein the processor is programmed to provide driving advice to a train operator of the train via the user interface based on the determined location of the train and the track profile.

13. The method of claim 12, wherein the processor is programmed to output train operator advice via the user interface if a change in the operation of the train is required.

14. The method of claim 12, wherein the track profile includes speed restrictions along the particular route.

15. The method of claim 14, wherein the processor is programmed to output driving advice that takes into consideration the speed restrictions along the particular route.

16. A method of providing advice to a train operator for train navigation, the method comprising:

providing a train control system for positioning onboard a train, wherein the train control system includes a processor, a database associated with the processor that includes a track profile having predetermined parameters on how the train should be operated along a particular route, an antenna for receiving a turnout indication signal from a wayside transponder, and a user interface coupled to the processor, wherein the processor is programmed to provide driving advice to a train operator of the train via the user interface based on the determined location of the train and the track profile, to determine the location of the train from the turnout indication signal, to assess whether a change in the operation of the train is required as a result of a change in the particular route that will occur from an upcoming turnout indicated by the turnout indication signal, and to predict changes in the particular route based on the received wayside transponder signal;

receiving a turnout indication signal from a wayside transponder;

determining a location of the train in relationship to at least one track turnout based on the turnout indication signal;

identifying whether a change in the particular route of the train is required based on the turnout indication signal; and determining whether a change in the operation of the train is required as a result of the turnout indication signal.

17. A method of providing advice to a train operator for train navigation, the method comprising:

providing a train control system for positioning onboard a train, wherein the train control system includes a processor, a database associated with the processor that includes a track profile having predetermined parameters on how the train should be operated along a particular route, and an antenna for receiving a turnout indication signal from a wayside transponder, wherein the processor is programmed to determine the location of the train from the turnout indication signal, to assess whether a change in the operation of the train is required as a result of a change in the particular route that will occur from an upcoming turnout indicated by the turnout indication signal, and to select an appropriate route for the train based at least in part on the wayside transponder signal;

receiving a turnout indication signal from a wayside transponder;

determining a location of the train in relationship to at least one track turnout based on the turnout indication signal;

identifying whether a change in the particular route of the train is required based on the turnout indication signal; and determining whether a change in the operation of the train is required as a result of the turnout indication signal.

18. A method of providing advice to a train operator for train navigation, the method comprising:

providing a train control system for positioning onboard a train, wherein the train control system includes a processor, a database associated with the processor that includes a track profile having predetermined parameters on how the train should be operated along a particular route, an antenna for receiving a turnout indication signal from a wayside transponder, and a user interface coupled to the processor, wherein the processor is programmed to provide driving advice to a train operator of the train via the user interface based on the determined location of the train and the track profile, to determine the location of the train from the turnout indication signal, and to assess whether a change in the operation of the train is required as a result of a change in the particular route that will occur from an upcoming turnout indicated by the turnout indication signal, wherein the driver advise comprises a new route the train is supposed to switch to based on the wayside transponder signal and how the driver should operate the train on the new route; and receiving a turnout indication signal from a wayside transponder;

determining a location of the train in relationship to at least one track turnout based on the turnout indication signal;

identifying whether a change in the particular route of the train is required based on the turnout indication signal; and determining whether a change in the operation of the train is required as a result of the turnout indication signal.

* * * * *